US009525235B2

(12) United States Patent
Listing et al.

(10) Patent No.: US 9,525,235 B2
(45) Date of Patent: Dec. 20, 2016

(54) ELECTRICAL CONNECTOR AND METHOD FOR PRODUCING AN ELECTRICAL CONNECTOR

(71) Applicant: Tyco Electronics AMP GmbH, Bensheim (DE)

(72) Inventors: Martin Listing, Langen (DE); Stefan Siegert, Bensheim, DE (US)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/644,297

(22) Filed: Mar. 11, 2015

(65) Prior Publication Data

US 2015/0263446 A1 Sep. 17, 2015

(30) Foreign Application Priority Data

Mar. 11, 2014 (DE) ..... 10 2014 204 484

(51) Int. Cl.
*H01R 13/514* (2006.01)
*H01R 13/502* (2006.01)
(Continued)

(52) U.S. Cl.
CPC ..... *H01R 13/502* (2013.01); *H01R 13/4367* (2013.01); *H01R 43/00* (2013.01);
(Continued)

(58) Field of Classification Search
CPC ..... H01R 13/518; H01R 23/7073; H01R 13/4223; H01R 13/514; H01R 13/4362
(Continued)

(56) References Cited

U.S. PATENT DOCUMENTS 3,555,488 A * 1/1971 McIver ..... H01R 12/89 439/260
3,627,929 A * 12/1971 Gilissen ..... H04Q 1/142 200/51.1
(Continued)

FOREIGN PATENT DOCUMENTS

CN 1933252 A 3/2007
EP 0042692 A1 6/1981
(Continued)

OTHER PUBLICATIONS

European Search Report, App. No. 15157989.3, dated Sep. 1, 2015, 9 pages.
Abstract for FR2450511A1, dated Sep. 26, 1980, 1 pages.

*Primary Examiner* — Thanh Tam Le
(74) *Attorney, Agent, or Firm* — Barley Snyder

(57) ABSTRACT

An electrical connector is disclosed having a housing and a splayed member connected to the housing. The housing has two contact receiving passageways spaced a first distance apart from each other, and two contacts, each of which are positioned in one of the contact receiving passageways. The splayed member has a terminating end distal to the contact receiving passageways, a contacting end proximate to the contact receiving passageways, and two opposite dividing surfaces in contact with the contacts. The two opposite dividing surfaces are spaced apart a second distance at the terminating end and taper down to a smaller third distance in a direction towards the contact receiving passageways.

18 Claims, 5 Drawing Sheets

(51) Int. Cl.
*H01R 13/436* (2006.01)
*H01R 43/00* (2006.01)
*H01R 43/22* (2006.01)
*H01R 13/533* (2006.01)

(52) U.S. Cl.
CPC ..... *H01R 43/22* (2013.01); *H01R 13/533* (2013.01); *Y10T 29/49204* (2015.01)

(58) Field of Classification Search
USPC ..... 439/540.1, 541.5, 595, 701, 752
See application file for complete search history.

(56) References Cited

U.S. PATENT DOCUMENTS 3,899,234 A * 8/1975 Yeager ..... H01R 12/89 439/260
4,303,294 A * 12/1981 Hamsher, Jr. ..... H01R 12/88 439/267
4,332,431 A 6/1982 Bobb et al.
4,468,073 A * 8/1984 Machcinski ..... H01R 12/88 439/266
4,606,594 A * 8/1986 Grabbe ..... H01R 12/88 439/260
5,273,456 A * 12/1993 Muzslay ..... H01R 13/641 439/188
5,980,325 A * 11/1999 Horchler ..... H01R 43/20 439/660
6,488,541 B1 * 12/2002 Takeuchi ..... H01R 43/00 439/660
7,153,172 B2 * 12/2006 Milligan ..... F02M 51/005 439/733.1
7,338,303 B1 * 3/2008 Yi ..... H01R 12/87 439/267
7,341,486 B2 * 3/2008 Onoda ..... H01R 13/4368 439/352
7,390,208 B1 * 6/2008 Sabo ..... H01R 12/57 439/260
2004/0132352 A1 7/2004 Ward et al.

FOREIGN PATENT DOCUMENTS

FR 2450511 3/1979
GB 1091626 11/1967
WO 9314537 A1 7/1993

* cited by examiner

ELECTRICAL CONNECTOR AND METHOD FOR PRODUCING AN ELECTRICAL CONNECTOR

CROSS-REFERENCE TO RELATED APPLICATIONS

This application claims the benefit of the filing date under 35 U.S.C. §119(a)-(d) of German Patent Application No. 10 2014 204 484.7, dated Mar. 11, 2014.

FIELD OF THE INVENTION

The invention relates to an electrical connector. The invention further relates to a method for producing an electrical connector.

BACKGROUND

Electrical connectors are used in many fields. Thus, it is often necessary to change the spacing between incorporated electrical conductors. Conventionally, there are various approaches for achieving this goal. For example, a flexible conductor, such as a cable, may be used. However, a disadvantage of this approach is that in order to contact the flexible conductor, other elements have to be fitted in the electrical connector when the conductor is to be soldered to a board. A second conventional approach uses rigid conductors which are first bent into a desired shape, and then inserted into the electrical connector. A third conventional approach uses rigid conductors which are first punched from a metal sheet in the desired form, and then inserted into the electrical connector. These solutions are relatively complex, thus increasing both the cost and complexity of the manufacturing process.

There is a need for an electrical connector that can incorporate changes in the spacing between electrical conductors, through a process that is both less complex and at a lower cost than the conventional approaches.

SUMMARY

An electrical connector has a housing and a splayed member connected to the housing. The housing has two contact receiving passageways spaced a first distance apart from each other, and two contacts, each of which are positioned in one of the contact receiving passageways. The splayed member has a terminating end distal to the contact receiving passageways, a contacting end proximate to the contact receiving passageways, and two opposite dividing surfaces in contact with the contacts. The two opposite dividing surfaces are spaced apart a second distance at the terminating end and taper down to a smaller third distance in a direction towards the contact receiving passageways.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
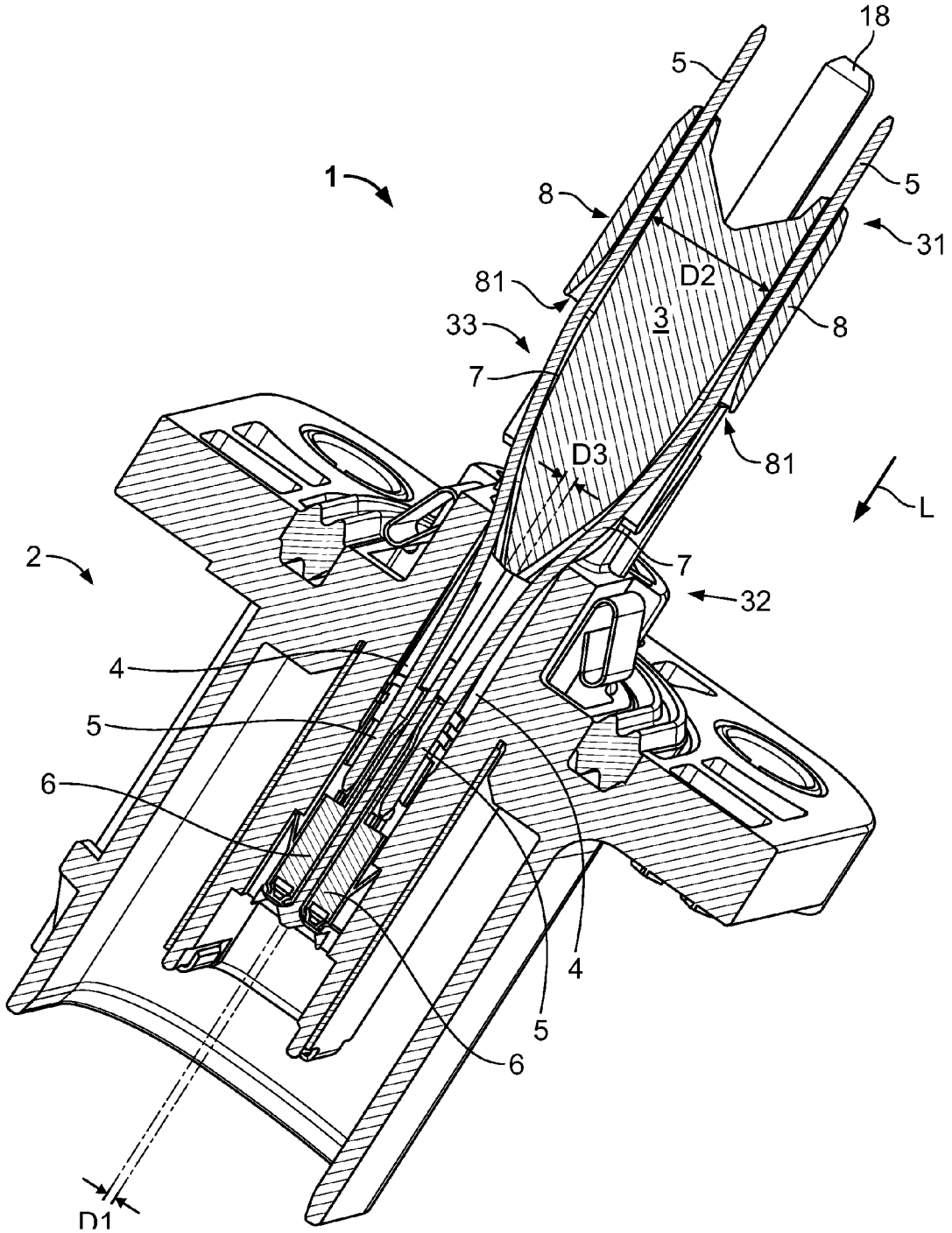
FIG. 1 is a cross-sectional view of an electrical connector.

An embodiment of an electrical connector 1 is shown in FIG. 1 having a housing 2 and a splayed member 3.

The housing 2 has two contact receiving passageways 4 into which one contact 5 is positioned. Each contact 5 is constructed as substantially rigid pegs or pins and has a degree of resilience.

A contacting end of each contact 5 is positioned in the housing 2, and terminals 6 in the form of sockets are fitted therein, in order to produce electrical contact with a mating connector in a simple manner. In an embodiment, the contacts 5 are pin contacts. When it is not necessary to produce a connection by means of insertion, the contacts 5 may be secured to an additional conductor by crimping or soldering.

The contact receiving passageways 4 extend in a linearly and in parallel with each other along a longitudinal direction L, through the housing 2.

The contacts 5 extend out of the housing 2 and continue along two dividing surfaces 7 of the splayed member 3. The splayed member 3 and dividing surfaces 7 increases a spacing between the two contacts 5 outside the housing 2. At a terminating end 31 of the splayed member 3, opposite a mating end 32 and facing away from the contact receiving passageways 4, the dividing surfaces 7 are spaced apart a second distance D2 with respect to each other, which is greater than a third distance D3 spacing between the contact receiving passageways 4 in the housing 2. At the terminating end 31 of the splayed member 3, the contacts 5 are spaced further apart from each other and may be soldered to a board. In order to achieve such an expansion, the contacts 5 are first inserted into the housing 2 and the splayed member 3 is subsequently displaced along the longitudinal direction L. Each of the two contacts 5 is positioned on one of the dividing surfaces 7 of the splayed member 3, and as the splayed member 3 is displaced, the two contacts 5 are displaced apart at the second distance D2. In order to achieve this spacing, the splayed member 3 tapers along the longitudinal axis from the terminating end 31 towards the contact receiving passageways 4. The splayed member 3 receives the contacts at the mating end 32 facing the contact receiving passageways 4. The process is simplified because the dividing surfaces 7 at the mating end 32 facing the contact receiving passageways 4 are spaced apart at the third distance D3 from each other to a smaller extent than, or at the most by the same extent as a first distance D1 spacing between the two contact receiving passageways 4. The third distance D3 at the tip of the splayed member 3 is thus, at a maximum, as large as the first distance D1.

A tapering portion 33 is positioned between the terminating end 31 and the mating end 32 of the splayed member 3. The tapering portion 22 has a wedge-like shape that tapers from the larger second distance D2 to the smaller third distance D3 along the longitudinal direction L towards the contact receiving passageway 4. The dividing surfaces 7 therefore curve outwards in a convex manner.

In a first step of manufacturing the electrical connector 1, terminating ends of the contacts 5, the terminating ends being opposite the contacting ends, are splayed outwards to a greater extent than the contacting ends. In a second step, the termination ends of the contacts 5 are redirected inwards again to be orientated in a linear manner by being positioned in tunnel-like contact positioning passageways 8, which are positioned proximate the terminating end 31 of the splayed member 3, extending away from the contact receiving passageways 4. These contact positioning passageways 8 thus act as positioning elements, which position the two contacts 5 so as to be parallel with each other again. At both the contacting and terminating ends, the contacts 5 thus extend in a parallel manner. Additionally, the contacting and terminating ends of a contact 5 are also parallel. In a transition region between the ends, the contact 5 extends in a slightly oblique manner.

In order to facilitate introduction of the contacts 5 into the contact positioning passageways 8, the contact positioning passageways 8 have funnel-shaped contact receiving openings 81 so that a cross-section of the contact positioning passageways 8 tapers in the direction away from the contact receiving passageways 4.

In an embodiment of FIG. 1, the housing 2 and the splayed member 3 are mated to each other, with the contacts 5 being in resilient contact with the splayed member 3 and the housing 2. Specifically, the contacts 5 resiliently contact the dividing surfaces 7 of the splayed member 3. The advantage of this configuration is that when the contacts 5 are subjected to tension and vibrations, such as when used in the automotive sector, the tension and vibrations have less influence on the contacts 5 than when the contacts 5 are not in a flexible or resilient contact with the splayed member 3 and housing 2.

In the mating position shown in the embodiment of FIG. 1, the housing 2 and splayed member 3 are connected by a frictionally engaged connection. However, one of ordinary skill in the art would appreciate that, the housing 2 and splaying member 3 may also be engaged or connected to each other in a different manner.

Figure 2:
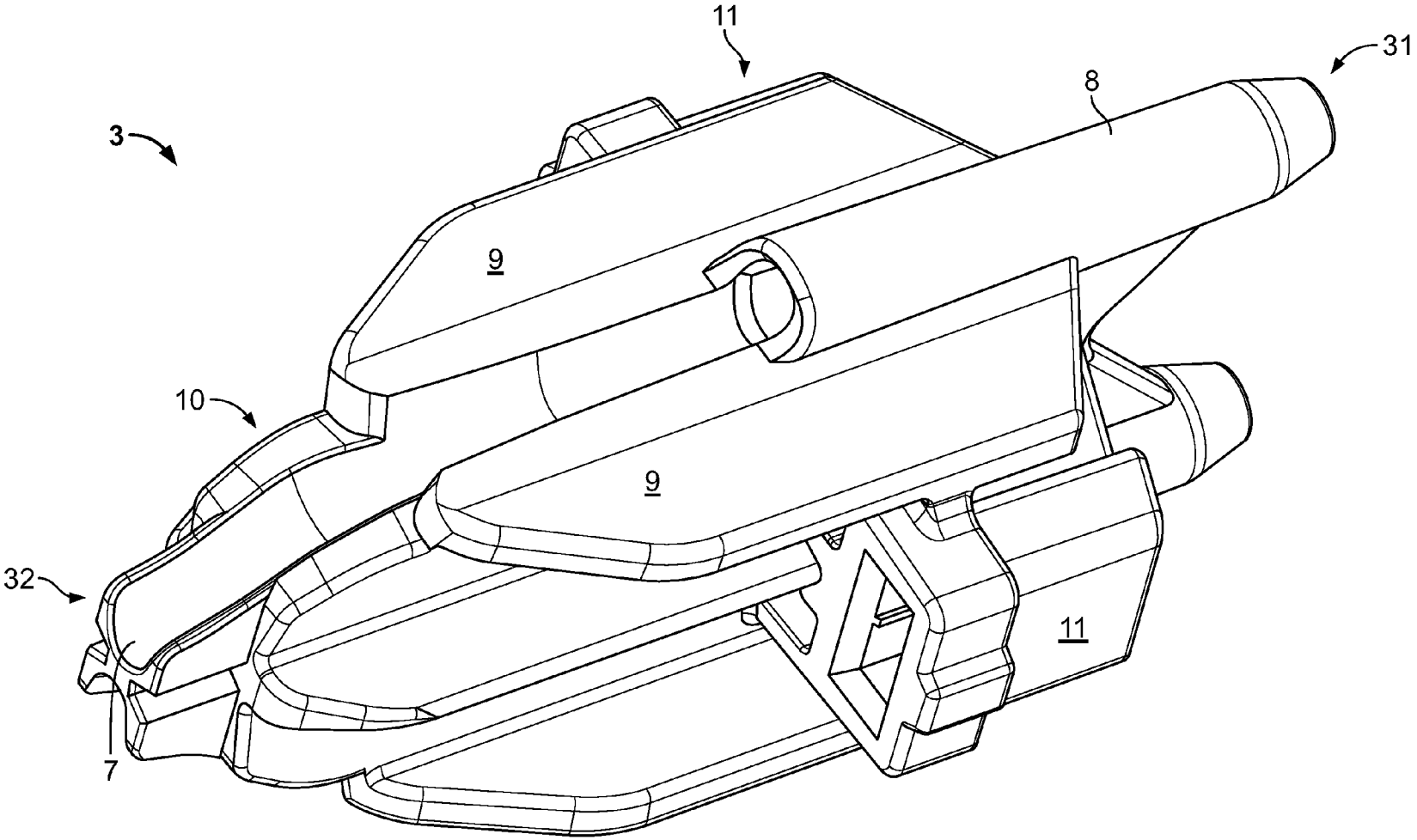
FIG. 2 is a perspective view of a splayed member.

In an embodiment of FIG. 2, the splayed member 3 has dividing surfaces 7 extending continuously from the mating end 32 to the terminating end 31, without steps being provided therebetween. The contacts 5 can thereby readily slide along the dividing surfaces 7.

The dividing surfaces 7 include a combination of grooves and the above discussed passageways 8 or tunnels so that lateral redirection or outward redirection is made more difficult. The contacts 5 are thus guided through the passageways and/or tunnels.

The dividing surfaces 7 are positioned on ribs 9 of the splayed member 3. The ribs 9 connect a central portion 10 of the splayed member 3 to contact guiding elements 11 for holding additional contacts 18. However, these additional contacts 18 differ from the contacts 5 discussed above, as the additional contacts 18 are not splayed open by the splayed member 3. The additional contacts 18 may therefore be used to guide the splayed member 3 along the longitudinal direction L to mate the splayed member 3 to the housing 2.

Figure 3:
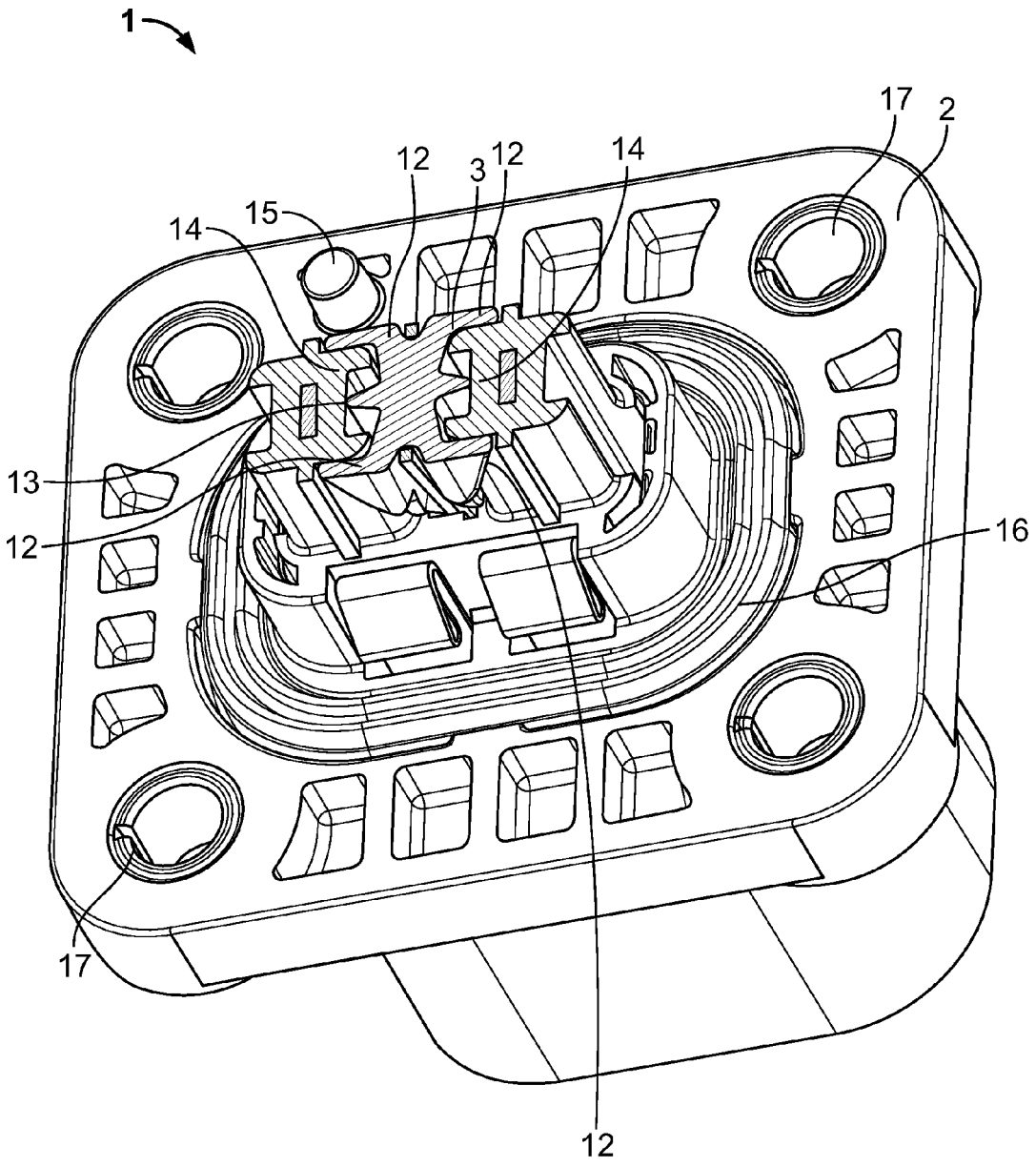
FIG. 3 is a partial cross-sectional view of the electrical connector.

In an embodiment of FIG. 3, a partial cross-section is shown of the electrical connector 1 where the splayed member 3 is secured to the housing 2 through a frictionally engaged connection. Two frictional locking members 12 positioned on the splayed member 3 each engage a complementary lock receiving member 14 positioned on the housing 2. Furthermore, additional frictional elements 13 on the frictional locking members 12 increase the level of friction between the splayed member 3 and the housing 2.

A coding element 15 may optionally be disposed on the housing 2, allowing the housing 2 to be connected to a correspondingly suitable counter-housing (not shown). For sealing with such a counter-housing, the housing 2 may have a seal 16. Furthermore, the housing 2 may be secured to the counter-housing or to a circuit board by a fastener positioned in fastener receiving passageways 17. Exemplary embodiments of the fastener include screws, bolts, or other common fasteners.

The housing 2 and the splayed member 3 are made of a plastics material for ease of production, and may be produced through injection-moulding.

Figure 4:
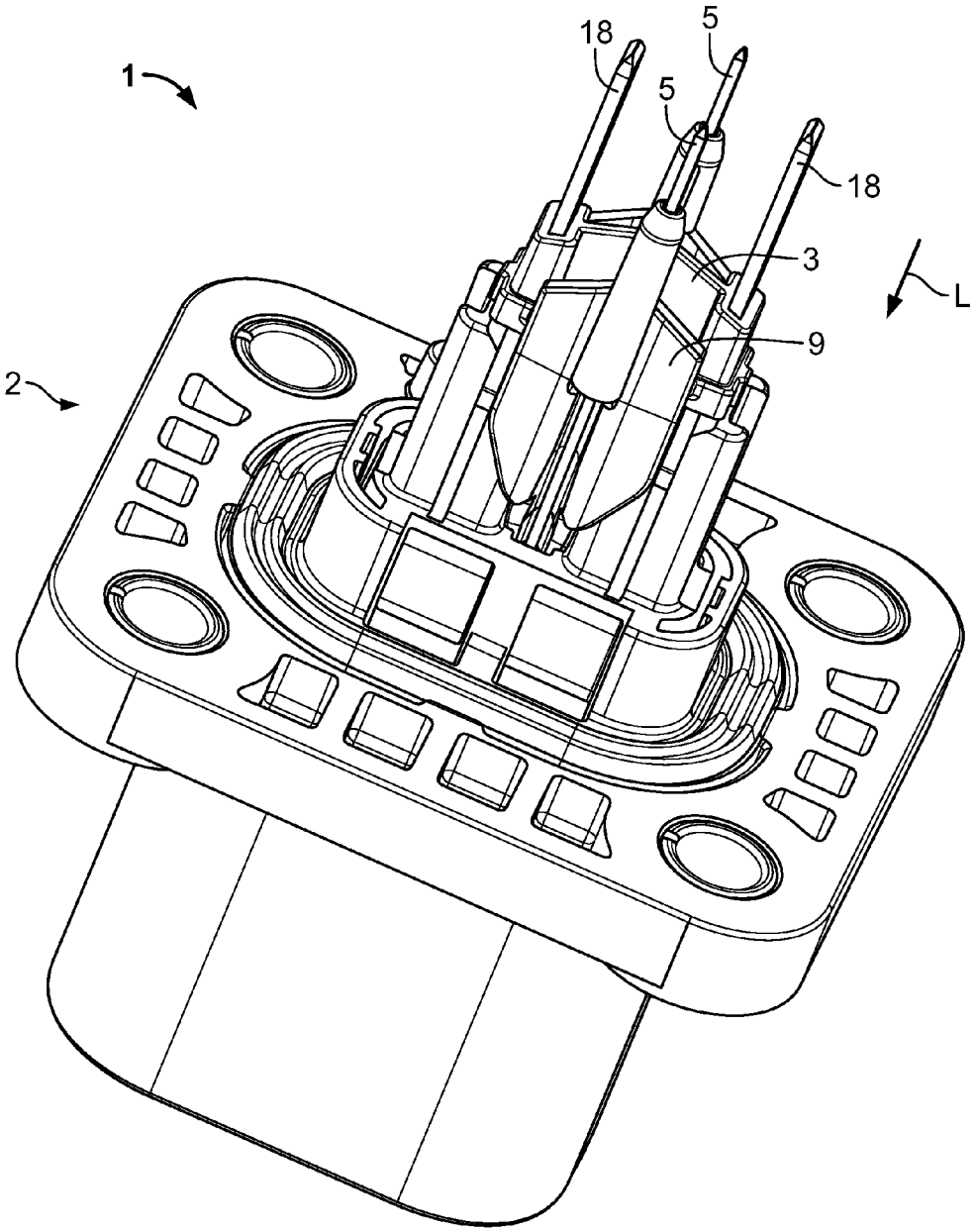
FIG. 4 is a perspective view of the electrical connector.
Figure 5:
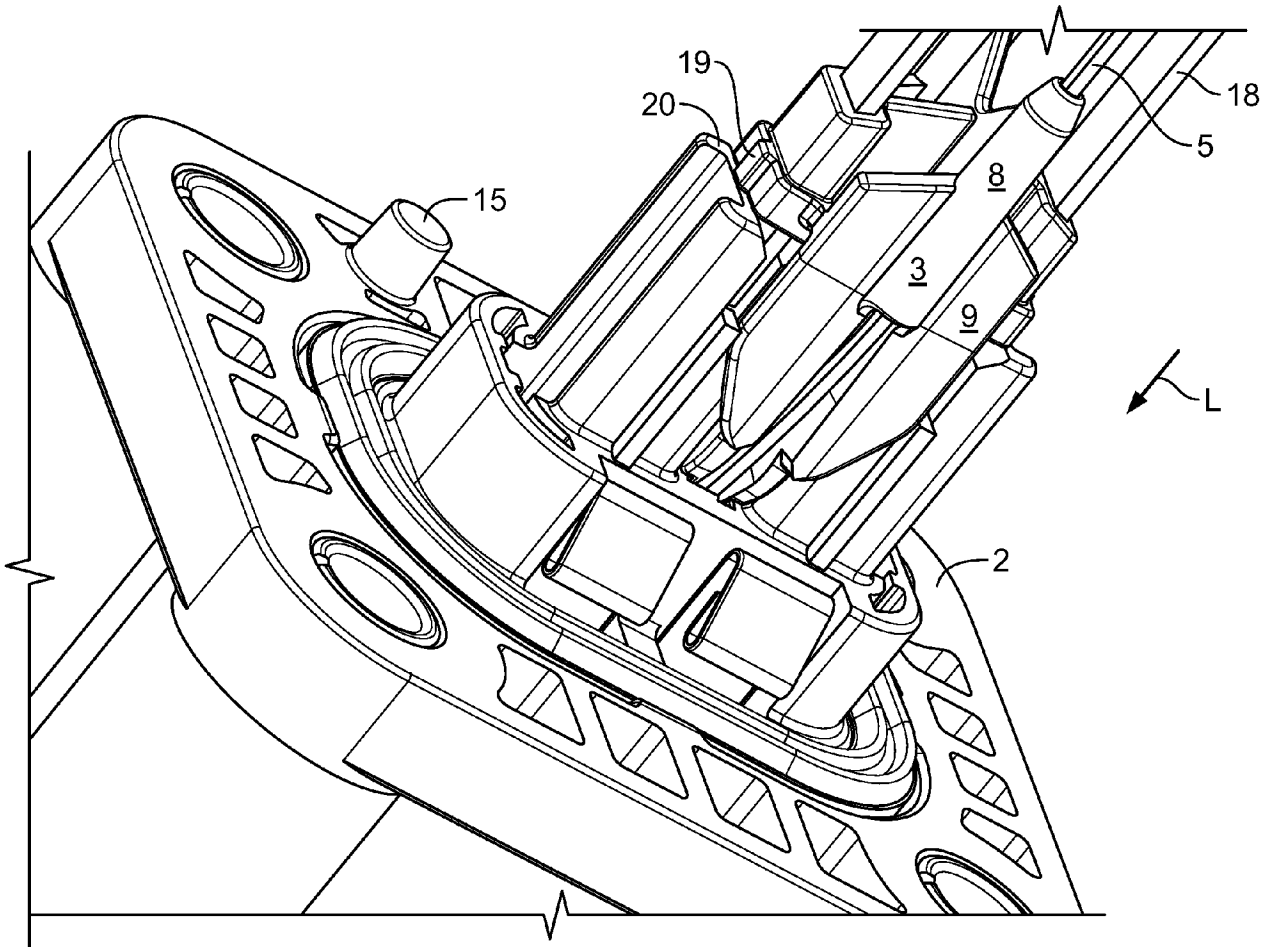
FIG. 5 is an enlarged perspective view of the electrical connector from FIG. 4.

In the embodiments of FIGS. 4 and 5, the both the splayed contacts 5 and the additional contacts 18 extend along the longitudinal direction L. The additional contacts 18 are constructed to be more stable and larger in diameter than the contacts 5. The additional contacts 18 may assist in guiding the splayed member 3 during mating to the housing 2. Furthermore, in an embodiment, the additional contacts 18 serve to transmit a power supply, whereas the contacts 5 serve to transmit signals.

The splayed member 3 may optionally have splayed member stops 19 disposed on an outer surface thereof, which engage complimentary housing stops 20 disposed on and outer surface of the housing 2 to thereby block movement in the longitudinal direction L.

One of ordinary skill in the art would appreciate that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector comprising:

a housing having two contact receiving passageways spaced a first distance apart from each other, and two contacts, each of which is positioned in one of the contact receiving passageways; and a splayed member connected to the housing, and having a terminating end distal to the contact receiving passageways, a contacting end proximate to the contact receiving passageways, and two opposite dividing surfaces in contact with the contacts, spaced apart a second distance at the terminating end and tapered down to a smaller third distance in a direction towards the contact receiving passageways, the contacts spaced further apart from each other along the two opposite dividing surfaces than within the contact receiving passageways.

2. The electrical connector according to claim 1, wherein the splayed member can be displaced along the longitudinal length of the contacts.

3. The electrical connector according to claim 1, wherein the third distance is approximately less than or equal to the first distance.

4. The electrical connector according to claim 1, wherein the contacts resiliently contact the dividing surfaces.

5. The electrical connector according to claim 1, wherein the splayed member at the terminating end has contact positioning passageways through which the contacts protrude.

6. The electrical connector according to claim 5, wherein the contact positioning passageways extend parallel with each other.

7. The electrical connector according to claim 5, wherein a cross-section of the contact positioning passageways tapers in the direction away from the contact receiving passageways.

8. The electrical connector according to claim 1, wherein a tapering portion is positioned between the terminating end and the mating end of the splayed member.

9. The electrical connector according to claim 8, wherein the tapering portion has a wedge-like shape.

10. The electrical connector according to claim 9, wherein the tapering portion tapers from the larger second distance to the smaller third distance along a longitudinal direction.

11. The electrical connector according to claim 1, wherein the dividing surfaces are outwardly curved in a convex manner.

12. The electrical connector according to claim 1, wherein the splayed member further comprises ribs positioned on an outer surface.

13. The electrical connector according to claim 12, wherein the dividing surfaces are positioned on the ribs.

14. A method for producing an electrical connector comprising the steps of (a) displacing a housing along a longitudinal direction towards a splayed member, the housing having two contact receiving passageways spaced a first distance apart from each other, and two contacts, each of which are positioned in one of the contact receiving passageways, and the splayed member having a terminating end distal to the contact receiving passageways, a contacting end proximate to the contact receiving passageways, and two opposite dividing surfaces in contact with the contacts, spaced apart a second distance at the terminating end and tapered down to a smaller third distance in a direction towards the contact receiving passageways, the contacts spaced further apart from each other along the two opposite dividing surfaces than within the contact receiving passageways; and (b) splaying the contacts apart as the housing is displaced.

15. The method according to claim 14, wherein the contacts are resiliently splayed apart.

16. The method according to claim 14, wherein the terminating ends of the contacts are splayed outwards to a great extent than the contacting ends.

17. The method according to claim 16, wherein the contacting ends and the terminating ends are positioned parallel to each other.

18. The method according to claim 17, wherein transition regions of the contacts are positioned between the contacting end and the terminating end of each contact, extending obliquely toward each other.

* * * * *